US008346104B2

(12) United States Patent
Yoshida et al.

(10) Patent No.: US 8,346,104 B2
(45) Date of Patent: Jan. 1, 2013

(54) IMAGE FORMING APPARATUS

(75) Inventors: Nobuyoshi Yoshida, Suntou-gun (JP); Satoru Inami, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 718 days.

(21) Appl. No.: 12/498,812

(22) Filed: Jul. 7, 2009

(65) Prior Publication Data

US 2010/0028025 A1 Feb. 4, 2010

(30) Foreign Application Priority Data

Jul. 31, 2008 (JP) ..... 2008-198572

(51) Int. Cl.
*G03G 15/00* (2006.01)

(52) U.S. Cl. ..... 399/12; 399/11; 399/25; 399/46; 399/53

(58) Field of Classification Search ..... 399/11–13, 399/24, 25, 46, 53, 71, 76, 77
See application file for complete search history.

(56) References Cited

U.S. PATENT DOCUMENTS

| | | | | |
|---|---|---|---|---|
| 5,475,471 | A | 12/1995 | Kisu et al. | 355/219 |
| 5,543,899 | A | 8/1996 | Inami et al. | 355/219 |
| 5,765,077 | A | 6/1998 | Sakurai et al. | 399/176 |
| 5,790,927 | A | 8/1998 | Ando et al. | 399/176 |
| 6,128,462 | A | 10/2000 | Kato et al. | 399/350 |
| 6,169,869 | B1 | 1/2001 | Inami et al. | 399/159 |
| 6,175,703 | B1 | 1/2001 | Nakazono et al. | 399/111 |
| 6,317,574 | B1 | 11/2001 | Shinohara et al. | 399/176 |
| 6,337,964 | B2 | 1/2002 | Inami et al. | 399/254 |
| 7,454,160 | B2 | 11/2008 | Ojima et al. | 399/267 |
| 2005/0196182 | A1* | 9/2005 | Taguchi et al. | 399/12 |
| 2006/0210289 | A1* | 9/2006 | Yamauchi et al. | 399/38 |

FOREIGN PATENT DOCUMENTS

| | | |
|---|---|---|
| JP | 6-118856 | 4/1994 |
| JP | 2001-305770 | 11/2001 |
| JP | 2004-341235 | 12/2004 |

* cited by examiner

*Primary Examiner* — Walter L Lindsay, Jr.
*Assistant Examiner* — Jessica L Eley
(74) *Attorney, Agent, or Firm* — Fitzpatrick, Cella, Harper & Scinto

(57) ABSTRACT

An image forming apparatus includes a process cartridge. In the case where the process cartridge is a fresh cartridge, after toner (developer) is sufficiently fed to a developer carrying member in the entire longitudinal area of the developer carrying member, an initializing operation for depositing the toner on a contact portion between an image bearing member and a cleaning blade.

15 Claims, 7 Drawing Sheets

IMAGE FORMING APPARATUS

FIELD OF THE INVENTION AND RELATED ART

The present invention relates to an image forming apparatus, to which a process cartridge is detachably mountable, for forming an image on a recording material (medium).

The image forming apparatus may include electrophotographic type or electrostatic recording type machines such as a copying machine, printers (a laser beam printer and an LED printer), a facsimile machine, a word processor, and a multifunction machine having functions of these machines.

The process cartridge is prepared by integrally supporting a rotatable image bearing member for bearing an electrostatic latent image and image forming process means acting on the image bearing member in a cartridge which is detachably mountable to an apparatus main assembly of the image forming apparatus. Examples of the process means include a charging means for electrically charging the surface of the image bearing member, an information writing means for forming the electrostatic latent image on the charged surface of the image bearing member, a developing means for developing the electrostatic latent image with a developer, and a cleaning means for removing the developer from the state of the image bearing member. The process cartridge includes the image bearing member and at least one of the above-described process means which are integrally supported in a cartridge. The recording material may, e.g., be a sheet member such as a sheet of paper, an OHP sheet, a label, or fabric. The apparatus main assembly is a portion of the image forming apparatus other than the process cartridge.

In a conventional image forming apparatus using an electrophotographic image forming process, a process cartridge system has been frequently used.

According to the process cartridge system, maintenance of the apparatus can be performed by a user himself (herself) without relying on a service person, so that operativity.

Incidentally, as the cleaning means for removing toner (developer) remaining on the surface of the image bearing member (hereinafter referred to as a photosensitive drum) in the process cartridge, a blade cleaning system has been used in many cases. In the blade cleaning system, as a cleaning member, a cleaning blade formed of an elastic material such as an urethane rubber is used. This cleaning blade provided in a counter direction with respect to a rotational direction of the photosensitive drum on a downstream side of a transfer portion with respect to the rotational direction of the photosensitive drum to press a sharp edge, provided to the cleaning blade, against the photosensitive drum surface, so that residual toner is scraped off.

According to the blade cleaning system, a high cleaning performance can be obtained. However, when a friction resistance between the cleaning blade and the photosensitive drum is high, considerable friction is produced between the blade edge and the photosensitive drum. Particularly, in a fresh process cartridge to be subjected to start of use by the user, there is no substance such that it functions as a lubricant such as the residual toner. Therefore, a large frictional force is produced between the blade edge and the photosensitive drum, so that problems such as turning-up, shuddering, and the like of the cleaning blade are liable to occur.

In order to solve the problems, as described in Japanese Laid-Open Patent Application (JP-A) Hei 06-118856, a lubricant of fine particles is applied, in the contact area of the cleaning blade with the surface of the photosensitive drum, as a lubrication action agent for decreasing the friction resistance between the cleaning blade and the photosensitive drum in many cases. As the lubricant of fine particles, e.g., it is possible to use toner particles, silica particles, fluorine-containing carbon particles, and the like. By applying the lubricant of fine particles, the friction resistance between the cleaning blade and the photosensitive drum can be suppressed at an initial stage of use of the process cartridge, so that it is possible to solve troubles (problems) such as noise, turning-up, and breakage of the cleaning blade during an operation of the image forming apparatus.

Further, as described in JP-A 2004-341235, when the process cartridge is judged as a fresh cartridge, the toner is deposited on the photosensitive drum by applying a predetermined charging bias and a predetermined developing bias. As a result, the toner is stagnated at the contact portion of the cleaning blade with the photosensitive drum, thus being used as the lubrication action agent.

Further, in a method described in JP-A 2001-305770, the use of a surface layer improved in lubricity of the photosensitive drum surface is proposed. According to this method, it is possible to solve the problems of the noise, turning-up, and breakage of the cleaning blade by imparting high lubricity to the photosensitive drum surface.

Incidentally, in the method described in JP-A Hei 06-118856, a step of dispersing the lubricant of fine particles in a solvent and then applying the resultant dispersion onto the cleaning blade is required, so that it is necessary to use the solvent.

In that respect, the means described in JP-A 2001-305770 does not require the application of the lubricant of fine particles to the cleaning blade. However, in the surface layer of the photosensitive drum for improving the lubricity as described in JP-A 2001-305770, the high lubricity is obtained but in the case of applying the charging bias, the surface layer is abraded due to electric discharge attack and is increased in friction resistance by an electric discharge product. For that reason, a step of supplying the toner to the cleaning blade before the high-lubricant layer is abraded off is needed.

In the method described in JP-A 2004-341235, e.g., in the case where the process cartridge is left standing for long time in a state in which a longitudinal direction thereof is vertically oriented, the toner of a developing means in the process cartridge is localized one longitudinal side of a developer carrying member. When such a process cartridge is mounted in an apparatus main assembly of the image forming apparatus, the toner does not present in an entire longitudinal area of the developer carrying member immediately after start of drive of the developer carrying member. In such a state, the toner is not uniformly coated on the developer carrying member, so that the toner cannot be uniformly supplied to the entire longitudinal area of the cleaning blade even when the toner on the developer carrying member is deposited on the photosensitive drum. Thus, there was a possibility of an occurrence of turning-up of the cleaning blade.

SUMMARY OF THE INVENTION

The present invention has been accomplished in order to solve the above-described conventional problems.

A principal object of the present invention is to provide an image forming apparatus causing no turning-up of a cleaning blade irrespective of a state of a developing means even when a fresh process cartridge is used.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiment 1

<General Structure of Image Forming Apparatus>

Figure 2:
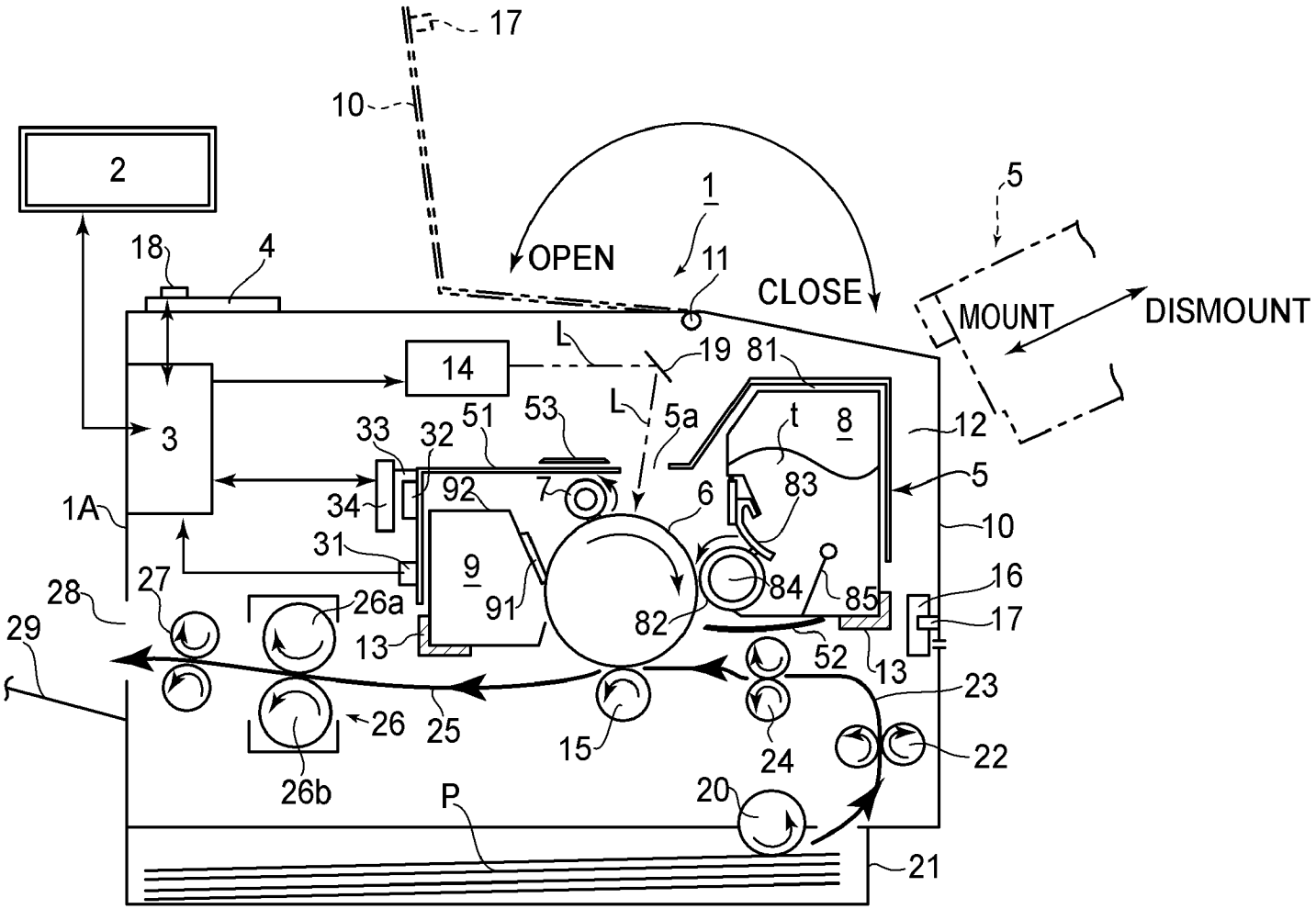
FIG. 2 is a schematic view of the image forming apparatus in Embodiment 1.

FIG. 2 is a schematic view showing an image forming apparatus A in this embodiment. The image forming apparatus 1 is a laser beam printer of a process cartridge type using an electrophotographic process. That is, the image forming apparatus 1 is connected to a host device 2 such as a personal computer or an image reader through a LAN and carries out an image forming operation on a sheet-like recording material (recording medium) P on the basis of electric image information inputted from the host device 2 to a control circuit portion (control means: CPU) 3. The control circuit portion 3 gives and receives various pieces of the electric information between the control circuit portion 3 and the host device 2 or an operating portion 4 and subjects the image forming apparatus 1 to centralized control of an image forming operation in accordance with a predetermined control program or a predetermined reference table.

In the following description, a widthwise direction of a process cartridge (cartridge) 5 refers to a direction in which the cartridge 5 is mounted to and demounted from an apparatus main assembly 1A of the image forming apparatus 1. A longitudinal direction of the cartridge 5 refers to a direction perpendicular to the direction in which the cartridge 5 is mounted to and demounted from the apparatus main assembly 1A. Further, with respect to the cartridge 5, a front surface (side) refers to a surface (side) (a right-hand surface (side) in FIG. 2) opposite from an insertion leading end-side surface (a left-hand surface (side) in FIG. 2) with respect to the apparatus main assembly 1A. A rear surface (side) refers to an opposite surface (side) from the front state (side) as seen from the front surface (side). Left and right surfaces (sides) refer to those of the cartridge 5 as seen from the front surface (side) of the cartridge 5. Further, an upper surface (side) refers to a surface (side) located at an upper portion in a state in which the cartridge 5 is mounted to the apparatus main assembly 1A and a lower surface (side) refers to a surface (side) located at a lower portion of the cartridge 5. Further, with respect to the image forming apparatus 1, a front surface (side) refers to a surface (side) where an openable door (openable cover) 10 is provided. Left and right surfaces (sides) refer to those of the image forming apparatus 1 as seen from the front surface (side) of the image forming apparatus 1.

The cartridge 5 in this embodiment is prepared as a cartridge by integrally supporting a rotatable image bearing member 6 having a surface layer containing a lubricating material, and a charging means 7, a developing means 8, and a cleaning means 9 which are electrophotographic process means acting on the image bearing member 6 and is detachably mountable to the apparatus main assembly 1A. In this embodiment, the image bearing member 6 is a rotatable drum type electrophotographic photosensitive member (hereinafter referred to as a photosensitive drum). The charging means 7 electrically charges uniformly the (peripheral) surface of the photosensitive drum 6 to a predetermined polarity and a predetermined potential and in this embodiment, a contact charging roller is used as the charging means 7. The developing means 8 develops (visualizes) an electrostatic latent image formed on the surface of the photosensitive drum 6 with a developer (visible powder, hereinafter referred to as toner) t into a toner image. The cleaning means 9 removes transfer residual toner from the photosensitive drum surface. In this embodiment, as the cleaning means (member), a blade cleaning means using a cleaning blade (C blade) 91 is employed. A reference numeral 51 represents an outer casing (a cartridge frame) of the cartridge 5. The above-described photosensitive drum 6, charging means 7, developing means 8, and cleaning means 9 are assembled into the cartridge 5 in the outer casing with a predetermined positional relation.

In this embodiment, the cartridge 5 is subjected to a mounting and demounting (dismounting) operation by opening an openable door 10 of the apparatus main assembly 1A about a hinge portion 11 as indicated by a chain double-dashed line to widely expose the inside of the apparatus main assembly 1A. When the door 10 is opened, a cartridge mounting portion 12 in the apparatus main assembly 1A is in sight. At left and right wall portions of the mounting portion 12, when the mounting portion 12 is seen from an opening side on which the door 10 is opened, downward and backward guide rails (not shown) are in sight. The cartridge 5 is inserted into the mounting portion 12 along the guide rails by gripping a front portion of the cartridge 5 with hand and engaging left and right portions of the cartridge 5 with the left and right guide rails with a rear portion of the cartridge 5 forward. When the cartridge 5 is sufficiently inserted, the cartridge 5 is stopped by a positioning member 13 and is held at a predetermined mounting position, so that an exposure opening 5*a* located at an upper surface of the cartridge 5 faces a folding mirror 19 of a laser scanner unit 14 as an information writing means (an exposure device). Further, a downwardly exposed lower surface of the photosensitive drum 6 faces and contacts a transfer roller (a transfer means) 15. Then, the door 10 of the apparatus main assembly 1A is closed.

A door switch (a safety switch or an emergency stop switch) 16 is provided to the apparatus main assembly 1A. The door switch 16 is kept in an ON state by being pushed by a pusher 17 when the door 10 is closed to close a power source circuit (not shown) of the image forming apparatus 1. When the door 10 is opened, the pusher 17 is moved apart from the door switch 16, so that the door switch 16 is kept in an OFF state to open the power source circuit. That is, the door switch 16 is turned off when the door 10 of the image forming apparatus 1 is opened and is turned on when the door 10 is closed.

The cartridge 5 is mounted in the apparatus main assembly 1A in a predetermined manner and is then the door 10 is closed, so that the cartridge 5 is placed in a state in which the cartridge 5 is mechanically and electrically connected to the apparatus main assembly 1A side. That is, driven members (the drum, the developing roller, a toner stirring member, and the like) on the cartridge side are placed in a drivable state by a driving mechanism (not shown) on the apparatus main assembly 1A side. Further, various sensors (not shown) on the cartridge 5 side are placed in an electrically connected state with the control circuit portion 3 on the apparatus main assembly 1A side. Further, a predetermined bias can be applied from a bias application power source portion (not shown) on the apparatus main assembly 1A side to the charging roller, the developing roller, and the like on the apparatus main assembly 1A side.

Demounting of the cartridge 5 from the apparatus main assembly 1A is the reverse of the above-described mounting procedure. That is, in FIG. 2, when the door 10 is opened and then the cartridge 5 is pulled out upwardly and rightwardly, the cartridge 5 is guided by the above-described left and right guide rails to come out of the apparatus main assembly 1A from the mounting portion 12.

Incidentally, in this embodiment, when the cartridge 5 is demounted from the apparatus main assembly 1A, a drum shutter 52 is moved to a closing position in which the drum shutter covers the lower surface of the photosensitive drum 6, thus protecting the lower surface of the drum. The drum shutter 52 is moved to an opening position in interrelation with mounting movement of the cartridge 5 to the apparatus main assembly 1A during the mounting movement. Further, during a demounting (drawing) movement of the cartridge 5 from the apparatus main assembly 1A, the drum shutter is moved to the closing positions in interrelation with the demounting movement. Further, when the cartridge 5 is demounted from the apparatus main assembly 1A, an exposure portion shutter 53 is moved to a closing position in which the exposure opening 5*a* is closed. The exposure portion shutter 53 is moved to an opening position, during the mounting movement of the cartridge to the apparatus main assembly 1A, in interrelation with the mounting movement. Further, during the demounting movement of the cartridge 5 from the apparatus main assembly 1A, the exposure portion opening is moved to the closing position in interrelation with the demounting operation.

The image forming apparatus 1 is a stand-by state in which the image forming apparatus 1 is capable of performing an image forming operation under a condition in which a main (power) switch 18 of an operating portion 4 is turned on (power on) and the cartridge 5 is mounted in the apparatus main assembly 1A and in which the door switch 16 is turned on by the closing of the door 10.

In this stand-by state, when electrical image information for printing is inputted from the host device 2 into the control circuit portion 3, the control circuit portion 3 processes the inputted image information at an image processing portion (not shown) to execute an image forming process on the basis of an image formation start signal (print start signal).

That is, a driving motor (not shown) is actuated to rotationally drive the photosensitive drum 6 in a clockwise direction indicated by an arrow at a predetermined speed (process speed). The process speed of the image forming apparatus 1 in this embodiment is 150 mm/sec.

The surface of the rotatably driven photosensitive drum 6 is electrically charged uniformly to the predetermined polarity and the predetermined potential by the charging roller 7. The charging roller 7 is prepared by forming an electroconductive elastic member on the surface of a core metal and is rotatably held at both end portions of the core metal, thus being disposed in parallel to the photosensitive drum 6. Further, the charging roller 7 is disposed in contact with the surface of the photosensitive drum 6 with a predetermined pressing (urging) force and is rotated by the rotation of the photosensitive drum 6. In this embodiment, to the charging roller 7, a charging bias in the form of superimposed AC and DC voltages is applied through sliding contacts (not shown) by a charging bias applying power source (not shown). Specifically, an AC voltage of 1600 V in terms of a peak-to-peak voltage and a DC voltage of −600 V are applied. As a result, the surface of the photosensitive drum 6 is electrically charged uniformly to a potential of approximately −600 V. The charging bias to be applied to the charging roller 7 may also be only the DC voltage. Further, the charging means 7 may also be a corona charger of a non-contact charging type.

The charged surface of the photosensitive drum 6 is subjected to laser scanning exposure by the laser scanner unit 14, so that the electrostatic latent image corresponding to the image information is formed on the surface of the photosensitive drum 6. The unit 14 includes a semiconductor laser, a polygonal mirror, a correction lens (f-θ lens), and the like and outputs laser light L modulated correspondingly to time-serial electric digital pixel signal for the image information inputted from the host device 2 to the control circuit portion 3. The laser light L is reflected by the folding mirror 19 to enter the cartridge 5 from the exposure opening 5*a*, so that the surface of the photosensitive drum 6 is subjected to the scanning exposure. The potential of the drum surface portion (exposed portion) subjected to irradiation with the laser light L is decayed, so that the electrostatic latent image corresponding to the scanning exposure pattern is formed on the surface of the photosensitive drum 6 on the basis of a potential contrast between the exposed portion and a drum surface portion (non-exposed portion) which has not been subjected to the irradiation with the laser light L.

The electrostatic latent image is developed as the toner image by the developing means 8. As a developing method, a jumping developing method, a two component developing method, or the like may be used. In the case of the printer, image exposure and reverse development are frequently used in combination.

In this embodiment, the electrostatic latent image is formed by image exposure for exposing an image portion, on which the toner is to be deposited, to light and then is reversely developed with negatively chargeable one component toner (negative toner) by using a developing device of a jumping developing type as the developing means 8. The developing device 8 will be described specifically later.

The control circuit portion 3 rotationally drives a (sheet) feeding roller 20 with predetermined control timing. As a result, one of sheets of a recording material P, as a recording medium, stacked and accommodated in a cassette 21, is separated and fed. The thus fed recording material P passes through sheet path 23 including a conveyance pair 22 to reach a registration roller pair 24 configured to be subjected to ON/OFF control of rotation with predetermined control timing. The registration roller pair 24 temporarily stops a leading end of the recording material P in a rotation OFF surface to make correction of oblique movement of the recording material P. Then, the registration roller pair 24 introduces the recording material P into a transfer nip, which is a contact portion between the photosensitive drum 6 and a transfer roller 15, by being turned on for rotation with the predetermined control timing. That is, the recording material P is synchronized with the toner image on the photosensitive drum 6 by the registration roller pair 24 to be sent to the transfer nip. During nip-conveyance of the recording material P through the transfer nip, to the transfer roller 15, a transfer bias of a predetermined potential and an opposite polarity (positive in this embodiment) to the toner charge polarity is applied from a transfer bias power source (not shown). As a result, the toner images on the surface of the photosensitive drum 6 are successively transferred electrostatically onto the surface of the recording material predetermined.

The recording material coming out of the transfer nip is separated from the surface of the photosensitive drum 6 and passes through a sheet path 25 to be introduced into a fixing device (fixing means) 26. The recording material P introduced into the fixing device 26 is heated and pressed during nip-conveyance in a fixing nip which is a press-contact portion between a fixing roller 26*a* and a pressing roller 26*b*, so that the unfixed toner image is fixed on the recording material surface as a fixed image. Then, the recording material P is relayed to a discharging roller pair 27 and passes through a (sheet) discharge opening 28 to be discharged on a (sheet) discharging tray 29 located outside the apparatus.

The surface of the photosensitive drum 6 after the separation of the recording material is subjected to removal of residual deposited product such as transfer residual toner or the like by the cleaning blade 91 of the cleaning device 9 to be cleaned, thus being repeatedly subjected to image formation. The transfer residual toner or the like removed from the drum surface by the cleaning blade 91 is collected in a residual toner container 92.

The cleaning blade 91 is provided counter-directionally with respect to the drum rotational direction in order to obtain a high cleaning performance to contact the photosensitive drum 6 in the predetermined area so as to create a nip, in which the cleaning blade 91 cleans the surface of the photosensitive drum 6 so as to remove the deposited product such as the transfer residual toner by scraping. The cleaning blade 91 is constituted by a supporting metal plate and a rubber blade.

In the drum contact area of the cleaning blade 91, coating or the like as a means for reducing the frictional resistance is not applied. That is, with respect to the cartridge 5, in a fresh state, particles (powder) having a lubrication action exerted between the cleaning blade 91 and the photosensitive drum 6 are not applied in the drum contact area of the cleaning blade 91.

Here, with respect to the cartridge 5, a fresh cartridge or the fresh state means a cartridge in an unused state from factory shipment until a user mounts the cartridge to the apparatus main assembly 1A of the image forming apparatus 1 to start use of the cartridge for image formation.

<Photosensitive Drum 6>

Figure 3:
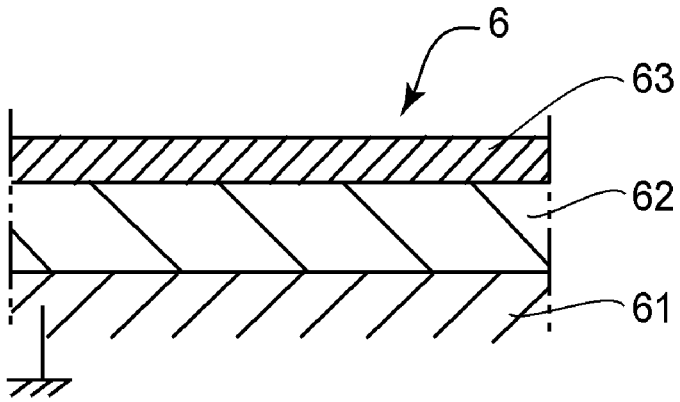
FIG. 3 is a schematic view showing a layer structure of a photosensitive drum.

FIG. 3 is a schematic view of a layer structure of the photosensitive drum 6 as the image bearing member. The photosensitive drum 6 includes an electroconductive support 61 and an electrophotographic photosensitive layer (charge generating layer) 62 formed on the support 61. Further, on the photosensitive layer 62, a surface layer (charge transporting layer) 63 is formed.

The surface layer 63 is formed by applying and drying a coating liquid principally including a charge transporting material, a binder resin material, and a lubricating material which are dissolved in a solvent. As the charge transporting material, it is possible to use various compounds such as triarylamine compounds, hydrazone compounds, stilbene compounds, pyrazoline compounds, oxazole compounds, triarylmethane compounds, triazole compounds, and the like.

As the binder resin material, it is possible to use, e.g., polyester resin, polyacrylic resin, polyvinyl carbazole resin, phenoxy resin, polycarbonate resin, polystyrene resin, polyvinyl acetate resin, polysulfone resin, polyallylate resin, vinylidene chloride-acrylonitrile copolymer resin, and polyvinyl benzol resin.

Further, as the lubricating material, a comb-like polymer is used. The lubricating material is commercially available from Toagosei Co., Ltd. under the trade name of Symac US-270, US-380, US-450, etc. In this embodiment, Symac US-270 is used.

The photosensitive drum 6 in this embodiment has a coefficient of kinetic friction (μ) of 0.40 in the fresh cartridge. The coefficient of kinetic friction is changed to 0.60 to 1.0 in measurement after a first preparatory operation for printing described later. This is because the coefficient of kinetic friction is increased due to abrasion of the surface layer by electric discharge attack and an electric discharge product when the charging bias is applied during the preparatory operation for printing.

In such a condition, when drive of the photosensitive drum 6 is performed in the absence of the lubricant at the contact portion between the photosensitive drum 6 and the cleaning blade 91, turning-up of the cleaning blade 91 is liable to occur. Particularly, when the coefficient of kinetic friction of the photosensitive drum 6 at its surface is 0.5 or more, the turning-up of the cleaning blade 91 occurs. Incidentally, the measurement of the coefficient of kinetic friction after a preparatory operation for printing is performed after the toner on the surface of the photosensitive drum 6 is removed since the coefficient of kinetic friction of the photosensitive drum 6 alone cannot be accurately measured in the presence of the toner on the photosensitive drum 6.

The measurement of the coefficient of kinetic friction (μ) was performed by using a surface property tester ("HEIDON-14", mfd. by SHINTO Scientific Co., Ltd.) under a normal temperature/normal humidity (25° C./50% RH) environment. Specifically, the cleaning blade 91 was placed in contact with the photosensitive drum 6 in a state in which a certain load was applied to the cleaning blade 91. Then, when the photosensitive drum 6 was rotationally driven at 50 rpm, a frictional force exerted between the photosensitive drum 6 and the cleaning blade 91 was measured as an amount of strain of a strain gauge attached to the cleaning blade 91 side, followed by conversion into a tensile load.

The coefficient of kinetic friction can be obtained from [force (g) applied onto photosensitive drum 6]/[load (g) applied onto blade] when the cleaning blade is in operation. The blade used was an urethane rubber blade (a rubber hardness=67 degrees) and the measurement was performed under a load of 100 gf at an angle of 27 degrees with respect to a width direction.

<Developing Device 8>

The developing device 8 in this embodiment uses negatively chargeable one component magnetic toner as a developer (toner) t. The developing device 8 includes a developer container (toner container) 81 containing the toner t, a non-magnetic developing sleeve 82 as the developer carrying member for carrying and feeding the toner, and a developing blade 83 as a developer layer thickness regulating member for performing layer thickness regulation of the toner carried on the developing sleeve 82. In an inner space of the developing sleeve 82, a magnet roller 84 as a magnetic field generating member is inserted and provided non-rotatably. Further, the developing device 8 includes a toner stirring member (developer stirring member) 85 for loosening the toner t contained in the toner container 81 so as to be conveyed and fed to the developing sleeve 82. The developing sleeve 82 is rotatably disposed at an opening provided at a drum opposing portion of the toner container 81.

The developing sleeve 82 is formed with a pipe of aluminum or stainless steel and is rotatably supported by the toner container 81. As the developing sleeve 82, in this embodiment, an aluminum-made hollow-cylindrical pipe having a diameter of 16.0 mm was used. Further, the developing sleeve 82 is driven in a counterclockwise direction indicated by an arrow at a rotational speed of 300 rpm by a driving mechanism (not shown). At each of both longitudinal (axial) end portions of the developing sleeve 82, a spacer roller (not shown) is disposed. The developing sleeve 82 is configured to ensure a predetermined gap between its surface and the photosensitive drum surface by abutting outer peripheral surfaces of these spacer rollers against the photosensitive drum 6. The surface of the developing sleeve 82 is coated with a solvent in which carbon black, a charge control agent, and fine particles for roughening the developing sleeve surface are dispersed in a phenolic resin material so as to provide the toner with an appropriate electric charge when the developing sleeve 82 carries a predetermined amount of the toner. Further, by the coating with the coating liquid, the developing sleeve 82 has a surface roughness. In this embodiment, the developing sleeve 82 having an arithmetic average roughness Ra of 1.2 μm was used.

The magnet roller 84 is formed in a cylindrical shape and is provided with a plurality of alternating N-poles and S-poles with respect to its circumferential direction. The magnet roller 84 is, different from the rotatable developing sleeve 82, fixedly disposed non-rotatably inside the developing sleeve 82.

The developing blade 83 is constituted by a supporting member and an elastic blade so that the elastic blade is bent inwardly against elasticity in contact with the developing sleeve 82. The elastic blade is, e.g., formed of an urethane rubber in a plate-like shape. The elastic blade is fixed to a supporting metal plate at its base end portion and is elastically deformed by press-contact of its (free) end portion with the surface of the developing sleeve 82 at a predetermined pressure. The elastic blade regulates the layer thickness of the toner t attracted to the surface of the developing sleeve 82 by a magnetic force of the above-described magnet roller 84.

The stirring member 85 is rotationally driven at a rotational speed of 30 rpm by a driving mechanism (not shown). The stirring member 85 is prepared by providing a 50 μm-thick stirring sheet (film) of polyphenylene sulfide to a mounting shaft rotatably supported by the toner container 81. Further, the stirring member 85 is driven by the same driving system as that for the developing sleeve 82. In this embodiment, the developing sleeve 82, the stirring member 85, and the photosensitive drum 6 are driven by the same driving device.

The toner t is magnetically adsorbed and carried by the magnetic force of the magnet roller 84 at the surface of the developing sleeve 82 on the toner container 81 side and is fed by the rotation of the developing sleeve 82 into a developing area in which the developing sleeve 82 opposes the photosensitive drum 6. The toner is provided with an appropriate electric charge by triboelectric charge among toner particles due to the feeding thereof and by triboelectric charge due to rubbing between the developing sleeve 82 and the elastic blade during the toner layer thickness regulation by the developing blade 83. Then, by further rotation of the developing sleeve 82, the toner is fed into the developing area which is an opposing portion between the developing sleeve 82 and the photosensitive drum 6. To the developing sleeve 82, a predetermined developing bias in the form of superposed AC and DC voltages is applied from an AC developing bias application power source and a DC developing bias application power source through a sliding contact (not shown). In this embodiment, the toner on the developing sleeve 82 is jumped to the photosensitive drum 6 in the developing area to be electrostatically deposited on the electrostatic latent image, so that the electrostatic latent image is developed as a toner image.

<Operation Sequence of the Image Forming Apparatus>

Figure 4:
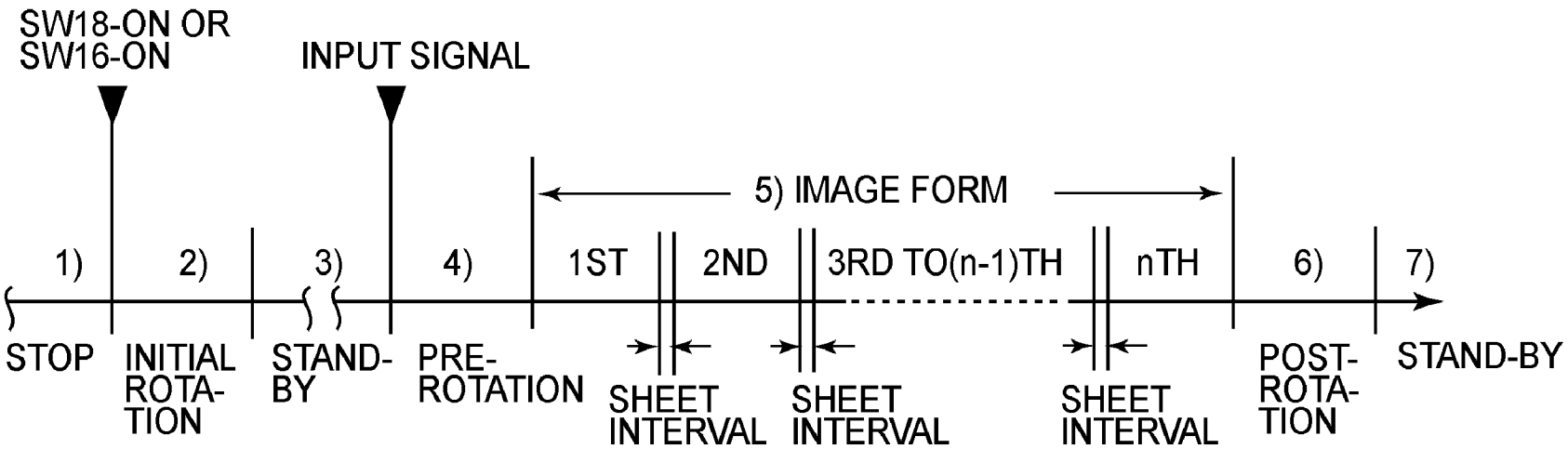
FIG. 4 is an operational process chart of the image forming apparatus.

FIG. 4 is an operation process chart of the image forming apparatus.

1) Rest State

When the power source of the image forming apparatus is turned off, i.e., when the main (power) switch 18 is turned off or the door switch 16 is turned off by opening the door 10, the power source circuit is opened (power OFF) and thus the image forming apparatus is kept in a rest (stop) state.

2) Preparatory Operation for Printing (Initial Rotation)

This operation is a starting operation (actuating operation) executed when the power source of the image forming apparatus is turned on. That is, an operation for effecting warming of required process devices including the drive of the photosensitive drum 6, the drive of the stirring member 85, and the charging bias application to the charging roller 7 by actuating a driving motor (main motor) (not shown) when the power source of the image forming apparatus is turned on.

The time when the power source of the image forming apparatus is turned on is the time when the main switch in an OFF state is turned on in a state in which the door switch 16 is an ON state (the door 10-CLOSE) or the time when the door switch 16 in the OFF state (the door 10-OPEN) is turned on (the door-CLOSE) in a state in which the main switch 18 is in the ON state. In either case, the power source circuit is closed (power ON), so that the image forming apparatus is kept in an operable state.

The preparatory operation for printing is a preparatory operation for causing the image forming apparatus to stable image formation. For example, control such that the state of the cartridge 5 is detected and settings of proper charging, developing, and transfer biases are made depending on the detected state is effected. It is also possible to effect process control such that in order to uniformize the surface potential of the photosensitive drum 6, a certain charging bias is applied or light exposure is made. That is, the preparatory operation for printing is a preparatory or adjusting sequence of various operations for going to a stand-by state in which printing becomes possible and the preparatory operation for printing is performed when the main switch 18 in the OFF state is turned on and when the door switch 16 in the OFF state is turned on.

3) Stand-By

After the predetermined preparatory operation for printing is completed, the drive of the driving motor is stopped, so that the image forming apparatus is kept in a stand-by state until an image formation start signal S is inputted.

4) Pre-Rotation Operation

On the basis of the input of the image formation start signal S, the driving motor is driven again, so that a predetermined pre-operation for image formation accompanied with the rotational drive of the photosensitive drum 6 is performed.

More specifically, the pre-operation is performed in the order of a: receiving of the image formation start signal S, b: image data expansion by a formation (in which an expansion time varies depending on an amount of the image data and a processing speed of the formatter), and c: start of the pre-rotation operation.

Incidentally, in the case where the image formation start signal S is inputted during the preparatory operation for printing of the above 2), after the completion of the preparatory operation for printing, the pre-rotation operation of 4) is performed with no stand-by of 3).

5) Image Forming Operation

When the pre-rotation operation is completed, subsequently, an image forming operation on predetermined are sheet (mono-print) or an image forming operation on a predetermined number of plural sheets (a continuous image forming job: multi-print) is performed, so that an image-formed recording material is outputted. "SHEET INTERVAL" is an interval portion between a trailing end of a recording material and a leading end of a subsequent recording material.

6) Post-Rotation Operation

The driving motor is continuously driven for a predetermined time even after the completion of the image forming operation on the predetermined are sheet or the predetermined number of plural sheets, so that a developer image formation completing operation accompanied with the rotational drive of the photosensitive drum 6 is performed.

7) Stand-By

When the post-rotation operation is completed, the drive of the driving motor is stopped and the image forming apparatus is kept in the stand-by state until a subsequent image formation start signal S is inputted. When the subsequent image formation start signal S is inputted, the sequence goes to the pre-rotation operation of the above 4).

<Exchange of Cartridge 5>

With the use of the cartridge 5 for the image formation, the toner (developer) t accommodated in the toner container 81 of the developing device 8 is consumed. Then, when the developer is consumed to such an extent that it is impossible for the user which has purchased the cartridge to obtain a satisfactory image quality, exchange of an old cartridge for a fresh cartridge is needed.

Therefore, e.g., a means for detecting remaining developer amount (not shown) is provided and a detect remaining amount value is compared with a preset threshold value for advance notice or warning of end of the lifetime of the cartridge by the control circuit portion 3. With respect to the cartridge showing the detected remaining (developer) amount value less than the threshold value, the advance notice or warning of end of the lifetime of the cartridge is displayed on a display portion (not shown) of the operating portion 4.

The exchange of the old cartridge 5 for the fresh cartridge 5 is performed, as described above, by demounting the old cartridge from the cartridge mounting portion 12 after opening the door 10 and then by mounting the fresh cartridge 5 to the cartridge mounting portion 12. In this case, as described above, the door 10 is opened, so that the door switch 16 is turned off to open the power source circuit even when the main switch 18 is on. As a result, the image forming apparatus is kept in the rest state to ensure electrical safety. The door 10 is closed again, so that the door switch 16 is turned on to close the power source circuit of the image forming apparatus. In this case, the control circuit portion 3 executes the preparatory operation for printing of 2) described above and then shifts the sequence to the stand-by of 3) described above. In the case where the image forming job is interrupted, the image formation on remaining sheets is carried out by performing the preparatory operation for printing of 2) and then performing the pre-rotation operation of 4) with no stand-by of 3) and then by shifting the sequence to the image forming operation of 5). That is, recovery of the interrupted image forming sequence is executed.

Further, not only in the case of the exchange of the old cartridge 5 for the fresh cartridge 5 but also in the case of jam clearance, maintenance and inspection of the image forming apparatus, and the like, the door 10 is opened and then demounting of the cartridge 5 is performed. Also in this case, the door switch 16 is turned off to open the power source circuit by opening the door 10, so that the image forming apparatus is kept in the rest state to ensure the electrical safety. Further, after the jam clearance, the maintenance and inspection of the image forming apparatus, or the like is completed, the cartridge 5 is mounted again. Then, the door 10 is closed, so that the door switch 16 is turned on to close the power source circuit.

Also, in this case, the control circuit portion 3 executes the preparatory operation for printing of 2) described above and then shifts the sequence to the stand-by of 3) described above. In the case where the image forming job is interrupted, the recovery of the interrupted image forming sequence is executed.

In summary, the control circuit portion 3 has a control mode in which the preparatory operation for printing including the drive of the photosensitive drum 6, the drive of the developing sleeve 82, the drive of the stirring member 85, and the application of the charging bias to the charging roller 7 is performed when the power source of the image forming apparatus is turned on.

In this embodiment, the above-described preparatory operation for printing includes the first preparatory operation for printing performed when the cartridge 5 mounted in the apparatus main assembly 1A is the fresh cartridge and a second preparatory operation for printing performed when the cartridge 5 is not the fresh cartridge. The first preparatory operation for printing includes the following initializing operation (initializing processing). That is, the initializing operation is such an operation that the toner t is deposited on the surface of the photosensitive drum 6 by the developing device 8 after the developing sleeve 82 and the stirring member 85 rotate at least one full circumference and then is deposited in the nip between the cleaning blade 91 and the photosensitive drum 6 (i.e., at their contact portion and the neighborhood of the contact portion). The second preparatory operation for printing does not include the initializing operation as in the first preparatory operation for printing. That is, the second preparatory operation for printing is an ordinary initial rotation operation.

Figure 1:
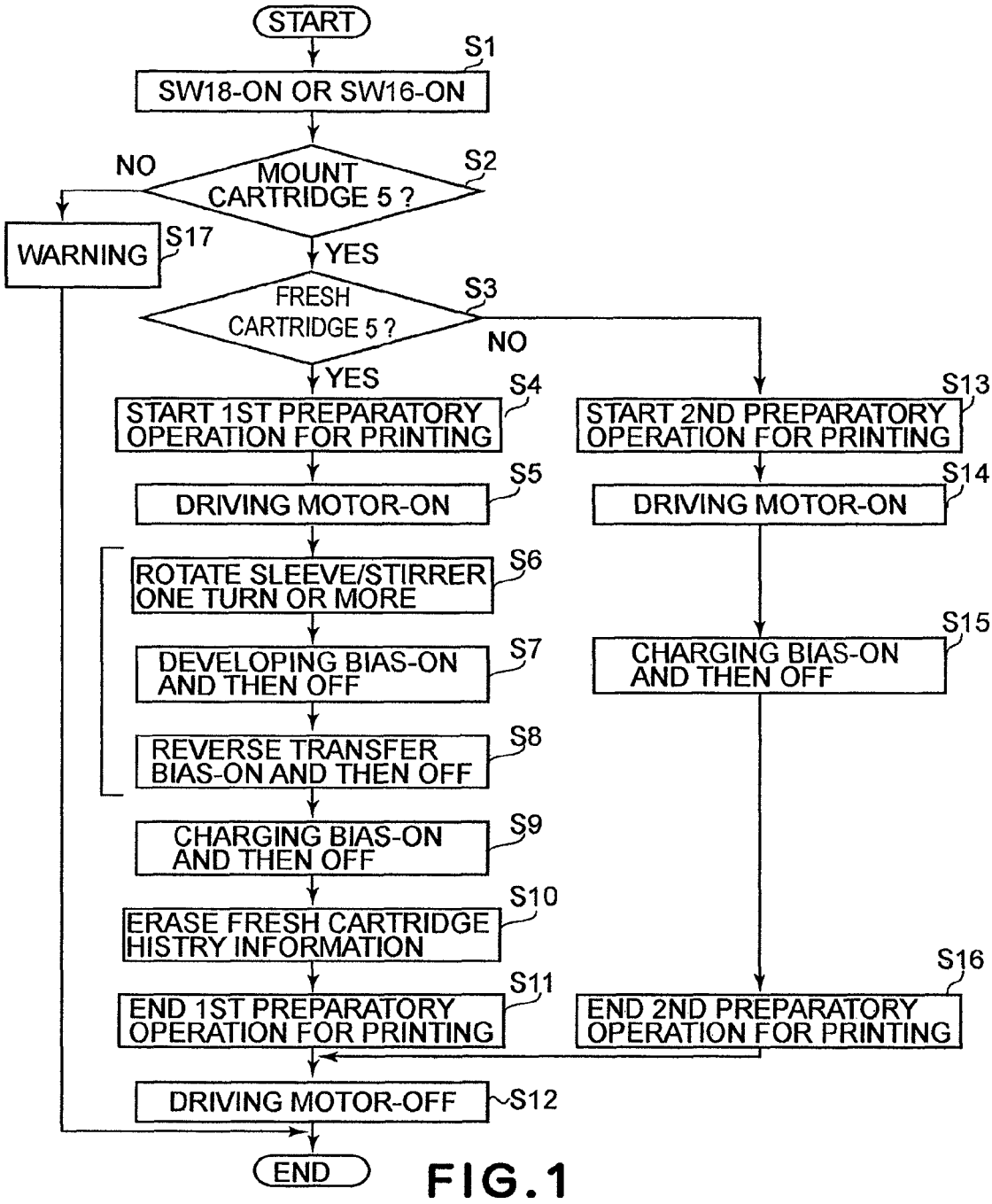
FIG. 1 is a flow chart of control in an initial rotation in an image forming apparatus in Embodiment 1.

FIG. 1 is a flow chart of the above-described control mode.

Step S1: The power source circuit is closed by turning on the power source of the image forming apparatus (the power source switch 18-ON or the door switch 16-ON).

Step S2: The control circuit portion 3 judges whether or not the cartridge 5 is mounted on the basis of a signal from a cartridge presence-absence detecting means 31 (FIG. 2). In the case where the control circuit portion 3 judges that the cartridge 5 is mounted, the procedure goes to a step S3. In the case where the control circuit portion 3 judges that the cartridge 5 is not mounted (including the case where the cartridge 5 is not properly mounted, the procedure goes to a step S17 and the control circuit portion 3 causes the operating portion 4 to produce warming display (error message), to the effect that the cartridge is not mounted or is improperly mounted, on the display portion (not shown) while keeping the driving motor in the OFF state.

Step S3: When the cartridge 5 is mounted, the control circuit portion 3 causes a fresh cartridge detecting means to detect whether or not the cartridge 5 is the fresh cartridge.

In this embodiment, judgment as to whether or not the cartridge 5 mounted to the apparatus main assembly 1A is the fresh cartridge is made by using a non-volatile storing means (a storing medium for storing information; hereinafter referred to as a memory) 32 provided to the cartridge 5, as shown in FIG. 2.

On the rear surface side of the cartridge 5 (on an insertion end-side surface of the cartridge 5 with respect to the apparatus main assembly 1A), the memory 32 and a cartridge-side transmitting portion 33 for controlling reading and writing of information with respect to the memory 32. The memory 32 and the transmitting portion 33 are integrally supported on a substrate and are provided to the cartridge 5. Further, in a state in which the cartridge 5 is mounted in the apparatus main assembly 1A in a predetermined manner, the cartridge-side transmitting portion 33 opposes and contact an apparatus main assembly-side transmitting portion 34 in a predetermined manner.

As a result, the control circuit portion 3 on the apparatus main assembly 1A side and the memory 32 on the cartridge 5 side are placed in an electrically communicatable state through the transmitting portions 34 and 33. That is, the reading of the memory content of the memory 32 by the control circuit portion 3 and the writing of the information in the memory 32 are enabled. The above-described memory 32 and transmitting portions 33 and 34 constitute the fresh cartridge detecting means. As the memory 32, an electronic memory of a normal semiconductor can be used with no particular limitation.

In this embodiment, the cartridge-side transmitting portion 33 and the apparatus main assembly-side transmitting portion contact each other to perform reading/writing data communication between the control circuit portion 3 and the memory 32. However, the data communication may also be performed in a non-contact state through electromagnetic radiation.

In the above-described constitution, an electrical circuit as a means for performing the reading and the writing of the information with respect to the memory 32 is created by the control circuit portion 3.

Cartridge characteristic values depending on characteristic of individual cartridges 5 and parameters and the like for charging a process condition are stored in the memory during factory shipment.

In this embodiment, as one of the parameters (storing information, detection information) stored in the memory 32, information on judgment as the whether or not the cartridge 5 is the fresh cartridge (fresh cartridge history information) is stored. Then, on the basis of this information, the control circuit portion 3 judges whether or not the cartridge 5 mounted in the apparatus main assembly 1A is the fresh cartridge.

Step S4: The control circuit portion 3 starts the first preparatory operation for printing in the case where the control circuit portion 3 judges that the cartridge 5 in the fresh cartridge in the step S3. In the case where the control circuit portion 3 judges that the cartridge 5 is not the fresh cartridge, the procedure goes to a step S13 in which the control circuit portion 3 starts the second preparatory operation for printing.

Steps S5 to S8: The first preparatory operation for printing includes the initializing operation in which the toner t is deposited on the surface of the photosensitive drum 6 after the developing sleeve 82 and the stirring member 85 rotate at least one full circumference and then is deposited in the nip between the cleaning blade 91 and the photosensitive drum 6.

That is, the control circuit portion 3 turns on the driving motor (S5). As a result, the drive of the photosensitive drum 6, the drive of the developing sleeve 82, and the drive of the stirring member 85 are started. Then, after the developing sleeve 82 and the stirring member 85 rotate at least one full circumference (S6), the control circuit portion 3 performs the application of the developing bias to the developing sleeve 82 for a predetermined time in a state in which the charging bias is not applied to the charging roller 7 (S7).

In this embodiment, the developing bias includes a AC voltage of 1600 V in terms of the peak-to-peak voltage and a DC voltage of −400 V. The drum potential is approximately 0 V, so that the negative toner carried on the developing sleeve 82 jumps to the photosensitive drum 6 to be deposited on the photosensitive drum surface in the entire effective (longitudinal) area of the developing sleeve 82.

Figure 5:
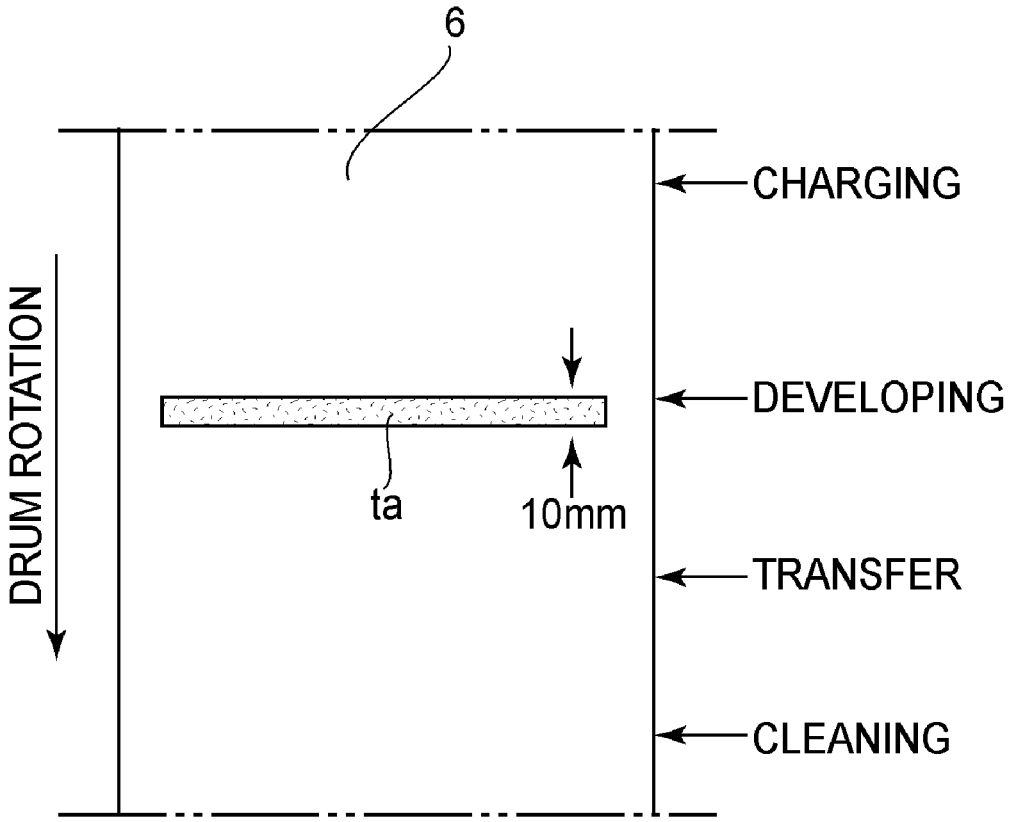
FIG. 5 is a schematic development view of the photosensitive drum in a state in which a developer is supplied by an initializing operation in a first preparatory operation for printing.

In this embodiment, an application time of the developing bias is 67 ms (milliseconds) and a toner image (black band) ta being about 10 mm in width with respect to the drum rotational direction (FIG. 5) is formed on the photosensitive drum 6. Incidentally, in this embodiment, as the developing bias, a voltage in the form of the DC voltage biased with the AC voltage is used but only the DC voltage may also be used.

The control circuit portion 3 applies a reverse transfer bias to the transfer roller 15 for a predetermined time immediately before the black band ta reaches the contact nip (transfer portion) between the photosensitive drum 6 and the transfer roller 15 by the rotation of the photosensitive drum 6 subsequent to the formation of the black band ta on the photosensitive drum 6 (S8). The reverse transfer bias is a repulsive bias (cleaning bias) of an identical polarity to the toner charge polarity. In this embodiment, the reverse transfer bias of −1000 V is applied from a reverse transfer bias application power source (not shown). This is because the transfer roller 15 is prevented from being contaminated with the toner by transfer of the black band ta from the photosensitive drum 6 onto the transfer roller 15 during passing of the transfer portion of the black band ta. The application of the reverse transfer bias is terminated after the black band ta passes through the transfer portion.

Then the black band ta having passed through the transfer portion reaches the contact nip between the cleaning blade 91 and the photosensitive drum 6 by further rotation of the photosensitive drum 6. The toner of the black band ta functions as the lubricant by stagnating in the contact nip between the cleaning blade 91 and the photosensitive drum 6. As a result, it was possible to solve the problems such as the noise, turning-up, and breakage of the blade at the initial use stage of the process cartridge 5. The above-described steps S6 to S8 constitute the initializing operation.

Steps S9 and S12: The control circuit portion 3 applies the charging bias to the charging roller 7 for a predetermined time (S9). In this embodiment, the charging bias includes an AC voltage of 1600 V in terms of the peak-to-peak voltage and a DC voltage of −600 V and is applied for a time corresponding to 2-full circumference of the drum. As a result, the drum surface potential is kept at approximately −600 V to decrease potential non-uniformity caused by the reverse transfer bias application or the like, so that proper image formation is effected when the procedure goes to the image forming operation.

Further, the control circuit portion 3 erases the fresh cartridge history information stored in the memory 32 when the initializing operation is completed (S10: writing in the memory 32 for erasing the history of the fresh cartridge). Then, when warming of other required process devices is completed, the first preparatory operation for printing is ended (S11) and the drive of the driving motor is stopped (S12), so that the image forming apparatus is kept in the stand-by state. In the case where the image forming job is interrupted, the control circuit portion 3 executes recovery of the interrupted image forming sequence.

Steps S13 to S16: The control circuit portion 3 starts the second preparatory operation for printing in the case where the control circuit portion 3 judges that the cartridge 5 is the fresh cartridge in the step S3. The second preparatory operation for printing is the ordinary initial rotation operation which does not contain the initializing operation (S6 to S8) in the first preparatory operation for printing. That is, the control circuit portion 3 turns on the driving motor (S14). As a result, the drive of the photosensitive drum 6, the drive of the developing sleeve 82, and the drive of the stirring member 85 are started. Further, the charging bias is applied to the charging roller 7 for a predetermined time (S15). The control circuit portion 3 ends the second preparatory operation for printing when warming of other required process devices is completed (S16) and stops the drive of the driving motor (S12), thus keeping the image forming apparatus in the stand-by state. In the case where the image forming job is interrupted, the control circuit portion 3 executes recovery of the interrupted image forming sequence.

Figure 6:
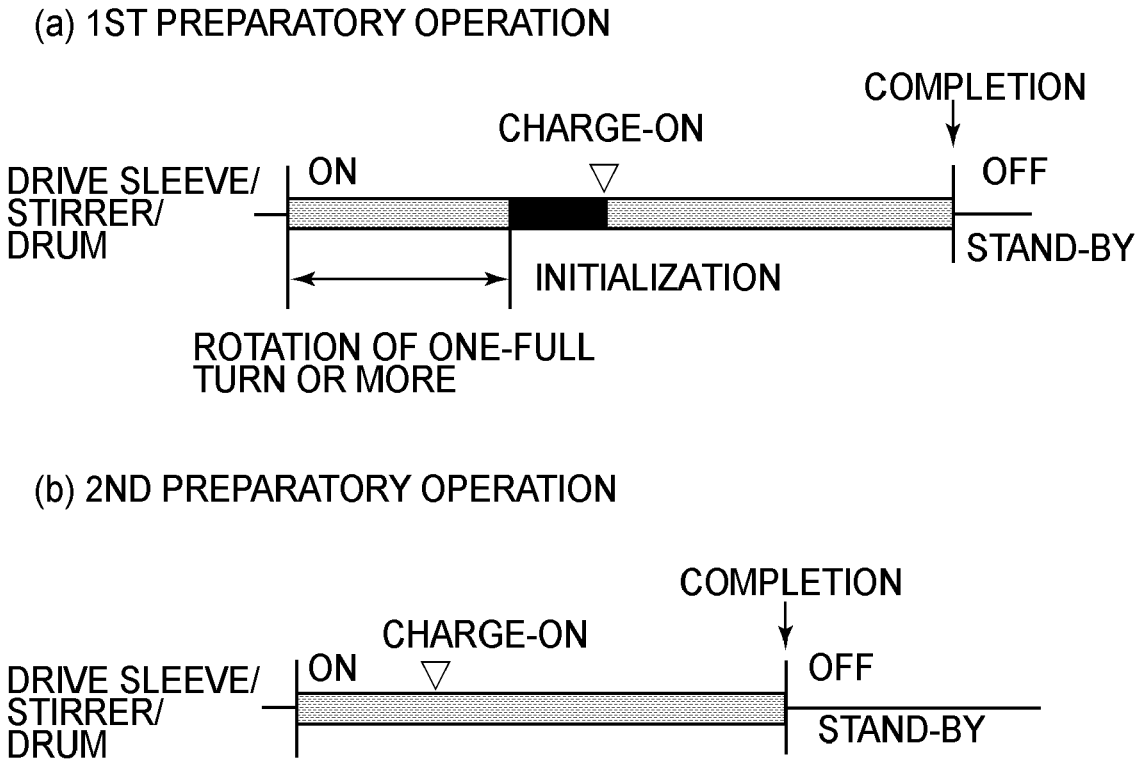
FIGS. 6(*a*) and 6(*b*) are sequence diagrams showing the first preparatory operation for printing and a second preparatory operation for printing, respectively.

FIGS. 6(*a*) and 6(*b*) are sequence diagrams of the above-described first preparatory operation for printing and second preparatory operation for printing, respectively. In the second preparatory operation for printing which is the ordinary initial rotation operation, the developing sleeve 82 is driven for several seconds to several tens of seconds in order to check the initial operation. In the first preparatory operation for printing performed in the case where the cartridge 5 is the fresh cartridge, the rotation of the developing sleeve/stirring member is effected and after the developing sleeve/stirring member rotate at least one full circumference, the initializing operation (steps S6 to S8) for feeding the toner from the developing sleeve 82 to the photosensitive drum 6 is performed. The charging bias application in the first preparatory operation for printing may desirably be performed after the initializing operation as shown in FIG. 6(*a*). This is because a high-lubricity layer of the photosensitive drum surface is abraded due to attack such as electric discharge by the charging bias application, so that the lubricity cannot be maintained.

Next, a relationship between the number of rotation of the developing sleeve/stirring member and the turning-up of the cleaning blade until the initializing operation in the first preparatory operation for printing will be described.

In Table 1, a result of study on shuddering and turned-up of the cleaning blade with respect to the number of rotation of the developing sleeve/stirring member until the initializing operation is shown, in which "A" represents no occurrence of both of the shuddering and the turning-up, "B" represents an occurrence of the shuddering, and "C" represents an occurrence of the turning-up.

TABLE 1

| | | | | | | |
|---|---|---|---|---|---|---|
| N.O.R. *1 Of D.S. *2 | 0 | 2.5 | 5 | 7.5 | 10 | 12.5 |
| N.O.R. of S.M. *3 | 0 | 0.25 | 0.5 | 0.75 | 1 | 1.25 |
| Evaluation | C | C | B | B | A | A |

*1: "N.O.R." represents the number of rotation (circumference).
*2: "D.S." represents the developing sleeve.
*3: "S.M." represents the stirring member.

This study was made in the following manner. In the cartridge 5, 300 g of the toner t was charged and in order to localize the toner t on one side of the cartridge (on one longitudinal end side in the toner container 81), random vibration was produced for 3 hours in a state in which a non-drive side (the one longitudinal end side) was located at a lower portion. Thereafter, the cartridge 5 was mounted in the apparatus main assembly 1A and then was subjected to image formation to evaluate a state of the cleaning blade.

This is because a longest time is required until the toner is fed to the entire developing sleeve when the drive is started from the state in which the toner is localized on the one longitudinal end side in the toner container 81.

As shown in Table 1, in the case where the number of rotation of the stirring member 85 until the initializing operation is 0.75 circumference or less, the shuddering or turning-up of the cleaning blade 91 occurred.

This is because the initializing operation is performed in a state in which the toner is not feed to a drive-side end of the developing sleeve 82 in the case where the number of rotation of the stirring member 85 is 0.75 circumference or less. This shows that it is necessary to perform the initializing operation after the stirring member 85 is rotated one full circumference or more.

Here, the toner localized on one side of the toner container 81 is stirred and fed by the stirring member 85. Every one full circumference rotation of the stirring member 85, the toner in the toner container 81 is fed to the neighborhood of the developing sleeve while extending in the longitudinal direction of the developing sleeve. When the number of rotation exceeds a certain value, the toner is fed to the entire longitudinal area of the developing sleeve 82. When the initializing operation is performed in this state, the shuddering or turning-up of the cleaning blade does not occur.

Incidentally, the toner feeding to the developing sleeve 82 is performed by the stirring member 85, so that there is a possibility that the toner feeding to the developing sleeve 82 is not performed at all depending on a stirring position before the drive in a state in which the number of rotation of the stirring member until the initializing operation is less than one full circumference. Therefore, the stirring member 85 is required to be rotated at least one full circumference (one full circumference or more).

Further, also in the case where the number of rotation of the developing sleeve 85 is less than one full circumference, similarly as in the case where the number of rotation of the stirring member 85 is less than one full circumference, the toner cannot be uniformly coated onto the developing sleeve 82 in some instances. Therefore, the developing sleeve 82 is also required to be rotated at least one full circumference.

In summary, the control circuit portion 3 has such a control mode that when the power to the image forming apparatus is turned on, the first preparatory operation for printing including the drive of the photosensitive drum 6, the drive of the developing sleeve 82, the drive of the stirring member 85, and the charging bias application to the charging roller 7 is performed or the second preparatory operation for printing is performed. The first preparatory operation for printing is executed when the cartridge 5 mounted in the apparatus main assembly 1A is detected as the fresh cartridge by the fresh cartridge detecting means 32, 33 and 34. The second preparatory operation for printing is executed when the cartridge 5 is detected as non-fresh cartridge. The first preparatory operation for printing includes such an initializing operation that the toner is deposited on the surface of the photosensitive drum 6 by the developing device 8 after the developing sleeve 82 and the stirring member 85 rotate at least one full circumference and then is deposited in the nip between the cleaning blade 91 and the photosensitive drum 6. As a result, it is possible to feed the developer through a (full) longitudinal width of the developer carrying member with reliability, so that the turning-up or the like of the fresh process cartridge can be prevented. The second preparatory operation for printing does not include such an initializing operation. By employing such a constitution, taking of a longer time than is necessary for the preparatory operation for printing can be prevented.

Embodiment 2

Figure 7:
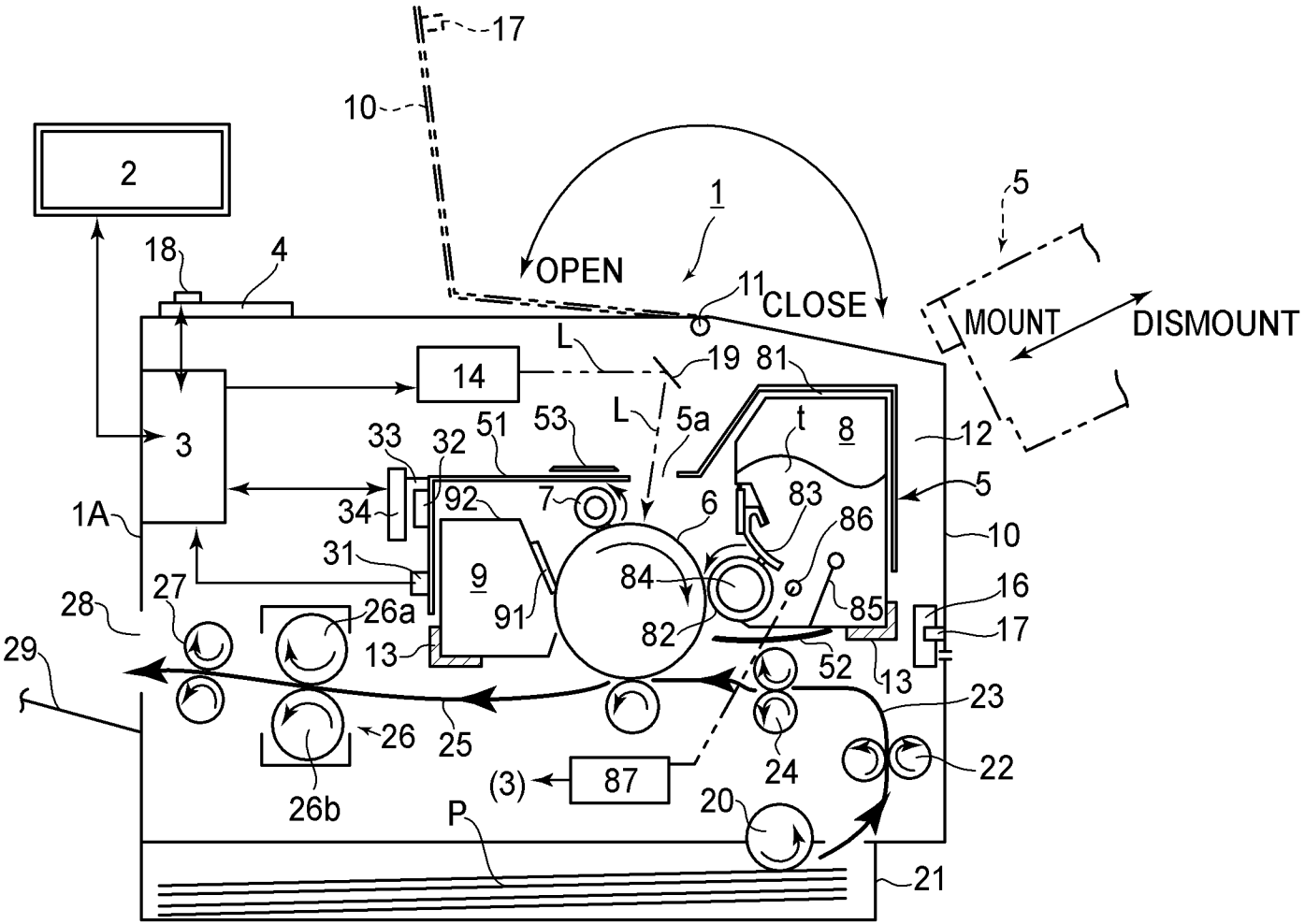
FIG. 7 is a schematic view of an image forming apparatus in Embodiment 2.

Next, Embodiment 2 will be described. FIG. 7 is a schematic structural view of an image forming apparatus 1 in this embodiment. This image forming apparatus 1 has a constitution similar to that of the image forming apparatus shown in FIG. 2 used for describing Embodiment 1 and is only different from the image forming apparatus in Embodiment 1 in that a toner feeding detecting means (developer feeding detecting means) for detecting an amount of toner between electrodes is added. Therefore, in the image forming apparatus of this embodiment shown in FIG. 7, members or means having the same constitution and function as those for the image forming apparatus in Embodiment 1 are represented by the same reference numerals or symbols to invoke the description in Embodiment 1, thus being omitted from the description.

The toner feeding detecting means added in this embodiment will be described. The toner feeding detecting means detects that the toner t contained in the toner container is fed in the entire longitudinal area of the developing sleeve 82. The toner feeding detecting means in this embodiment is constituted by an electrode rod 86 as an opposite electrode to the developing sleeve 87 as one of the electrodes and a toner amount detecting circuit 87. By detecting an electrostatic capacity between the developing sleeve 82 and the electrode rod 86, it is possible to measure the toner amount between the developing sleeve 82 and the electrode rod 86.

Figure 8:
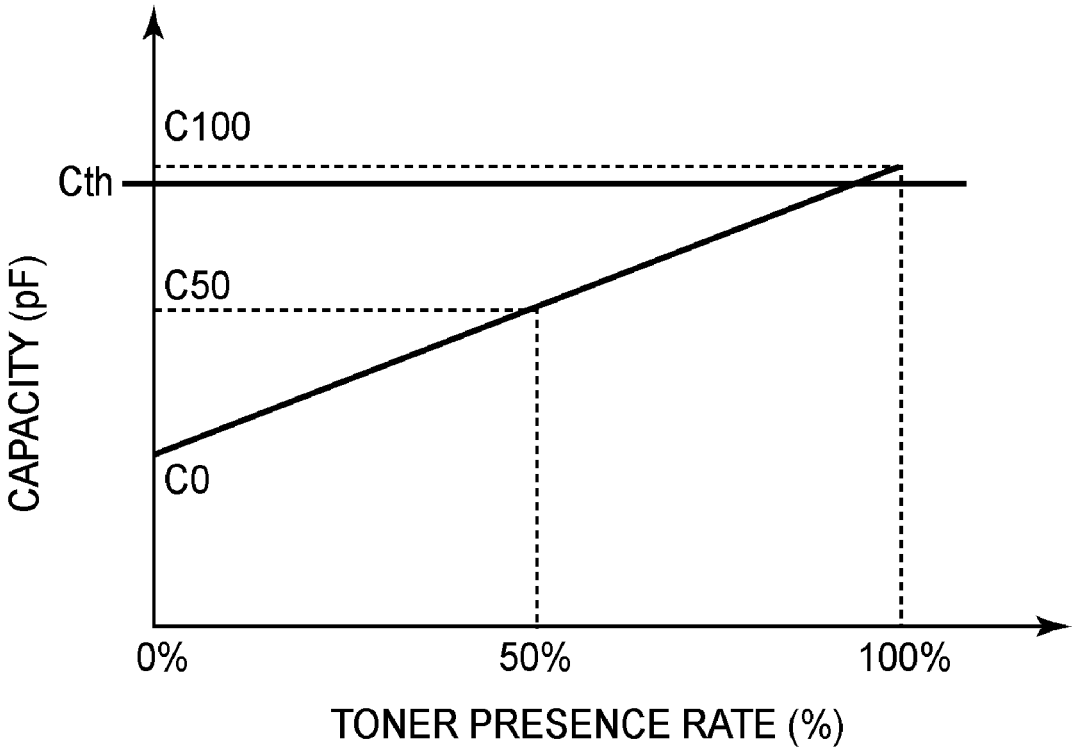
FIG. 8 is a graph showing a change in electrostatic capacity when toner is gradually filled between a developing sleeve and an electrode rod with respect to a longitudinal direction.
Figure 9:
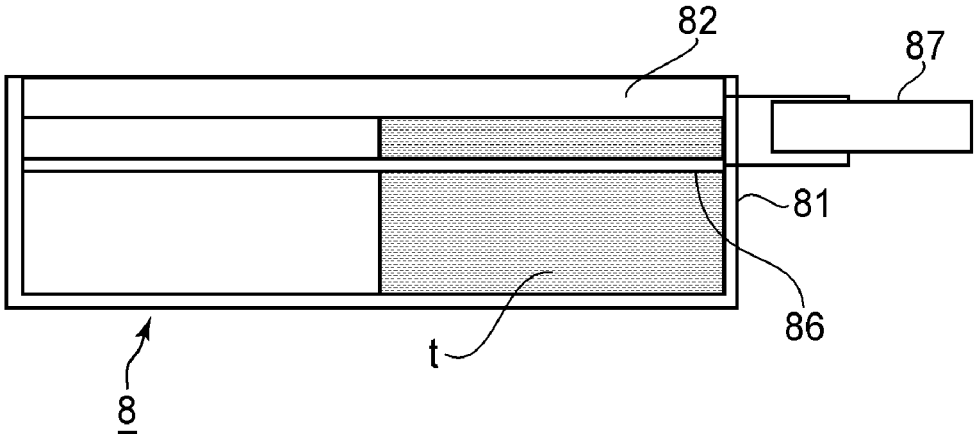
FIG. 9 is a schematic view of a developing device when the toner is present in an amount of 50% between the developing sleeve and the electrode rod.

A relationship between the toner amount (between the developing sleeve 82 and the electrode rod 86) and the electrostatic capacity (between the developing sleeve 82 and the electrode rod 86) will be described. FIG. 8 is a graph showing a change in electrostatic capacity when the toner t is gradually filled between the developing sleeve 82 and the electrode rod 86, wherein an abscissa represents a ratio of an amount of the toner t present between the developing sleeve 82 and the electrode rod 86 to a developing sleeve width and an ordinate represents the electrostatic capacity at that time. FIG. 9 is a schematic view of a state of a toner amount of 50%, wherein a state in which there is no toner t between the developing sleeve 82 and the electrode rod 86 is taken as 0% and a state in which the toner t is completely filled between the developing sleeve 82 and the electrode rod 86 is taken as 100%. The electrostatic capacity is increased with an increasing toner amount per a longitudinal length of the developing sleeve 82.

As shown in FIG. 9, in a state in which the toner t is localized in one-side half in the toner container 81, the toner is present only in a longitudinal-half area between the developing sleeve 82 and the electrode rod 86, so that the electrostatic capacity at that time is C50 in FIG. 8. When the developing sleeve 82 and the stirring member 85 are started to be driven, the toner t starts to extend in the longitudinal direction of the developing sleeve 82. For that reason, the electrostatic capacity is increased and then when the toner t is completely filled between the developing sleeve 82 and the electrode rod 86, the electrostatic capacity is C100 in FIG. 8. Therefore, Cth somewhat lower than C100 is taken as a threshold value and a point of time at which the electrostatic capacity value exceeds the threshold value is utilized as a trigger for start of the initializing operation, so that the toner can be supplied in the entire longitudinal area of the photosensitive drum 6 with reliability.

In summary, the control circuit portion 3 has such a control mode that when the power to the image forming apparatus is turned on, the first preparatory operation for printing including the drive of the photosensitive drum 6, the drive of the developing sleeve 82, the drive of the stirring member 85, and the charging bias application to the charging roller 7 is performed or the second preparatory operation for printing is performed. The first preparatory operation for printing is executed when the cartridge 5 mounted in the apparatus main assembly 1A is detected as the fresh cartridge by the fresh cartridge detecting means 32, 33 and 34. The second preparatory operation for printing is executed when the cartridge 5 is detected as non-fresh cartridge. The above procedure is similar to that in the case of Embodiment 1.

In this embodiment, in the first preparatory operation for printing, after the drive of the photosensitive drum 6, the drive of the developing sleeve 82, and the drive of the stirring member are started, the feeding of the toner t contained in the toner container 81 in the entire longitudinal area of the developing sleeve 82 is detected by the developer feeding detecting means 86 and 87. Further, the first preparatory operation for printing includes such an initializing operation that the toner t is deposited on the surface of the photosensitive drum 6 by the developing device 8 after the detection is performed and then is deposited in the nip between the cleaning blade 91 and the photosensitive drum 6. By this control, the initializing operation is executed in the state in which the state in which the developer is fed through a (full) longitudinal width of the developer carrying member with reliability, so that the turning-up or the like during the use of the fresh process cartridge can be prevented. The second preparatory operation for printing does not include such an initializing operation.

Other Embodiments (1) In the respective embodiments described above, the fresh cartridge detecting means (discriminating means) for detecting whether or not the cartridge 5 mounted in the apparatus main assembly 1A is the fresh cartridge is not limited to the means using the memory 32. For example, the fresh cartridge discriminating member may also be a fuse provided to the cartridge 5. The control circuit portion 3 detects whether or not the fuse of the cartridge 5 mounted in the apparatus main assembly 1A is blown out by an energization circuit as the fresh cartridge detecting means. When the energization circuit detects that the fuse is not blown out (when the energization is possible), the control circuit portion 3 judges that the cartridge 5 is the fresh cartridge. Then, the fuse is blown out (i.e., placed in a non-energization state to erase the fresh cartridge history information) so that the fresh cartridge discriminating member does not discriminate that the cartridge is the fresh cartridge after the above-described initializing operation.

(2) In the respective embodiments, the presence-absence detection of the cartridge 5 is performed by using the memory 32, so that it is also possible to employ a constitution in which the provision of the means 31 is omitted. That is, the control circuit portion 3 judges that the cartridge 5 is mounted in the case where the control circuit portion 3 is communicatable with the memory 32 on the cartridge 5 side. In the case where the control circuit portion 3 cannot communicate with the memory 32, the control circuit portion 3 judges that the cartridge 5 is not mounted (or that the cartridge 5 is not properly mounted).

(3) In the respective embodiments, the toner feeding detecting means 86 and 87 are not limited to those utilizing the electrostatic capacity between the above-described metal electrodes 86 and 82 and may also be replaced by a means, for detecting the toner amount through transmitted light of a laser, which is disposed on both longitudinal ends of the developing sleeve 82.

(4) The image forming apparatuses in the respective embodiments, are configured to directly transfer the toner image from the photosensitive drum 6 onto the recording material P but may also be an image forming apparatus of an intermediary transfer type in which the toner image is once transferred from the photosensitive drum 6 onto an intermediary transfer member and thereafter is transferred from the intermediary transfer member onto the recording material P.

(5) In the respective embodiments, the cartridge 5 is only required to be prepared by integrally supporting at least the photosensitive drum 6, the developing device 8, and the cleaning blade 91 and be detachably mountable to the apparatus main assembly 1A of the associated image forming apparatus 1.

(6) The image forming apparatus may also employ an electrostatic recording image forming process. In this case, the image bearing member functions as an electrostatic recording dielectric member. As the information writing means, an electrically discharging means such as an electrically discharging needle array or an electron gun is used to electrically discharge selective a uniformly charged surface of the electrostatic recording dielectric member, thus writing and forming an electrostatic latent image on the surface of the dielectric member.

(7) The image forming apparatus is not limited to those for single-color printing the above-described embodiments but may also in an in-line (tandem) type color image forming apparatus configured so that four cartridges having the above-described constitution are arranged and include corresponding developing devices containing color toners of yellow, magenta, cyan, and black, respectively. Also in such an image forming apparatus, by effecting the control as described in the respective embodiments, a similar functional effect can be achieved.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 198572/2008 filed Jul. 31, 2008, which is hereby incorporated by reference.

What is claimed is:

1. An image forming apparatus including a process cartridge that is detachably mountable to a main assembly of said image forming apparatus and includes a rotatable image bearing member for bearing an electrostatic latent image and includes a cleaning blade, provided counterdirectionally to a rotational direction of the image bearing member to contact the image bearing member in a predetermined area thereby forming a nip, for removing a developer from the surface of the image bearing member, said image forming apparatus comprising:

a charging device for electrically charging the surface of the image bearing member;

a developing device for developing, with a developer, an electrostatic latent image formed after the surface of the image bearing member is electrically charged, said developing device including a developer carrying member for carrying the developer and applying the developer to the image bearing member by being rotationally driven, and said developing device including a stirring member for stirring the developer accommodated in a developer container and feeding the developer to the developer carrying member by being rotationally driven;

a fresh cartridge detecting device for detecting whether or not the process cartridge is a fresh cartridge; and a control device for effecting control so that in the case where said fresh cartridge detecting device detects that the process cartridge is a fresh cartridge when power to said image forming apparatus is turned on, a preparatory operation for printing is performed including an initializing operation such that the developer is deposited on the surface of the image bearing member by said developing device after said stirring member rotates at least one full circumference thereof and then the developer is deposited in the nip, wherein the initializing operation is performed before application of a charging bias to said charging means.

2. An apparatus according to claim 1, wherein said control device effects control so that when said fresh cartridge detecting device detects that the process cartridge is not a fresh cartridge, a preparatory operation for printing including no initializing operation is performed.

3. An apparatus according to claim 1, wherein the image bearing member has a surface layer containing a lubricating material.

4. An apparatus according to claim 1, wherein after the preparatory operation for printing is performed, a coefficient of kinetic friction at the surface of the image bearing member is 0.5 or more.

5. An apparatus according to claim 1, wherein said stirring member is configured to feed the developer to the developer carrying member by rotation.

6. An apparatus according to claim 1, wherein when the process cartridge is in a fresh state, powder exerting a lubrication action between the cleaning blade and the image bearing member is not applied in the predetermined area in which the cleaning blade contacts the image bearing member.

7. An apparatus according to claim 1, wherein the process cartridge is provided with a storing medium for storing information on whether or not the process cartridge is a fresh cartridge.

8. An image forming apparatus including a process cartridge that is detachably mountable to a main assembly of said image forming apparatus and includes a rotatable image bearing member for bearing an electrostatic latent image and includes a cleaning blade, provided counterdirectionally to a rotational direction of the image bearing member to contact the image bearing member in a predetermined area thereby forming a nip, for removing a developer from the surface of the image bearing member, said image forming apparatus comprising:

a charging device for electrically charging the surface of the image bearing member;

a developing device for developing, with a developer, an electrostatic latent image formed after the surface of the image bearing member is electrically charged, said developing device including a developer carrying member for carrying the developer and applying the developer to the image bearing member by being rotationally driven, and said developing device including a stirring member for stirring the developer accommodated in a developer container and feeding the developer to the developer carrying member by being rotationally driven;

a fresh cartridge detecting device for detecting whether or not the process cartridge is a fresh cartridge;

a developer detecting device for detecting a presence state of the developer with respect to a longitudinal direction of the developer carrying member; and a control device for effecting control so that in the case where said fresh cartridge detecting device detects that the process cartridge is a fresh cartridge when power to said image forming apparatus is turned on, a preparatory operation for printing is performed including an initializing operation such that the developer is deposited on the surface of the image bearing member by said developing device, and wherein timing for performing the initializing operation is determined on the basis of information from said developer detecting device.

9. An apparatus according to claim 8, wherein said control device effects control so that when said fresh cartridge detecting device detects that the process cartridge is not a fresh cartridge, a preparatory operation for printing including no initializing operation is performed.

10. An apparatus according to claim 8, wherein the image bearing member has a surface layer containing a lubricating material.

11. An apparatus according to claim 8, wherein after the preparatory operation is performed, a coefficient of kinetic friction at the surface of the image bearing member is 0.5 or more.

12. An apparatus according to claim 8, wherein the initializing operation is performed before application of a charging bias to said charging device.

13. An apparatus according to claim 8, wherein said stirring member is configured to feed the developer to the developer carrying member by rotation.

14. An apparatus according to claim 8, wherein when the process cartridge is in a fresh state, powder exerting a lubrication action between the cleaning blade and the image bearing member is not applied in the predetermined area in which the cleaning blade contacts the image bearing member.

15. An apparatus according to claim 8, wherein the process cartridge is provided with a storing medium for storing information on whether or not the process cartridge is a fresh cartridge.

* * * * *